United States Patent [19]

Teng et al.

[11] Patent Number: 4,715,454

[45] Date of Patent: Dec. 29, 1987

[54] MECHANICAL DIRECTIONAL DRILLING JAR WITH SWIVEL MEANS

[76] Inventors: Chuan C. Teng, Lawrence Administrative Services Inc., P.O. Box 15250, Houston, Tex. 77220-5250; Rene A. Chapelle, Lawrence Administrative Services Inc., P.O. Box 2866, Conroe, Tex. 77305; John E. Blacklaws, Lawrence Administrative Services Inc., P.O. Box 15250, Houston, Tex. 77220-5250; Lee E. McComsey, Dailey Petroleum Services Inc., 12860 Old Seward Hwy., Anchorage, Ak. 99511-0049

[21] Appl. No.: 870,087

[22] Filed: Jun. 3, 1986

[51] Int. Cl.[4] ..... E21B 31/107

[52] U.S. Cl. ..... 175/299; 175/305; 166/178

[58] Field of Search ..... 175/299, 300, 304, 305, 175/306; 166/178; 285/276, 280, 373, 419

[56] References Cited

U.S. PATENT DOCUMENTS

| | | | |
|---|---|---|---|
| Re. 3,510 | 6/1869 | Bryan . | |
| Re. 9,072 | 2/1880 | McMullen . | |
| Re. 15,760 | 2/1924 | Kammerdiner . | |
| Re. 23,354 | 4/1951 | Storm . | |
| Re. 28,768 | 4/1976 | Mason | 175/297 |
| 2,915,289 | 12/1959 | Lawrence . | |
| 3,145,787 | 8/1964 | Brown | 175/299 |
| 3,208,541 | 9/1965 | Lawrence . | |
| 3,233,690 | 2/1966 | Lawrence . | |
| 3,316,986 | 5/1967 | Orr | 175/297 |
| 3,343,606 | 9/1967 | Dollison | 166/98 |
| 3,360,060 | 12/1967 | Kinley et al. | 175/299 |
| 3,371,730 | 3/1968 | Newman | 175/300 |
| 3,406,770 | 10/1968 | Arterbury et al. | 175/299 |
| 3,539,025 | 11/1970 | Sutliff et al. | 175/297 |
| 3,658,140 | 4/1972 | Berryman | 175/304 |
| 3,684,042 | 8/1972 | Graff | 175/302 |
| 3,685,598 | 8/1972 | Nutter | 175/302 |
| 3,685,599 | 8/1972 | Kisling, III | 175/304 |
| 3,716,109 | 2/1973 | Griffith | 166/178 |
| 3,804,185 | 4/1974 | Mason | 175/297 |
| 3,834,471 | 9/1974 | Bottoms | 175/304 |
| 3,853,187 | 12/1974 | Sutliff et al. | 175/297 |
| 3,860,076 | 1/1975 | White | 175/294 |
| 3,880,249 | 4/1975 | Anderson | 175/302 |
| 3,963,081 | 6/1976 | Anderson et al. | 175/304 |
| 3,987,858 | 10/1976 | Slator et al. | 175/297 |
| 4,004,643 | 1/1977 | Newman | 175/321 |
| 4,023,630 | 5/1977 | Perkin et al. | 175/297 |
| 4,036,312 | 7/1977 | DeLuish | 175/302 |
| 4,098,338 | 7/1978 | Perkins | 166/301 |
| 4,105,082 | 8/1978 | Cheek | 175/302 |
| 4,113,038 | 9/1978 | Clark | 175/300 |
| 4,124,245 | 11/1978 | Kuenzel | 294/86.3 |
| 4,186,807 | 2/1980 | Sutliff et al. | 175/302 |
| 4,333,542 | 6/1982 | Taylor | 175/299 |
| 4,376,468 | 3/1983 | Clark | 175/304 |
| 4,394,883 | 7/1983 | Briscoe | 175/304 |
| 4,494,615 | 1/1985 | Jones | 173/119 |
| 4,498,548 | 2/1985 | Teng | 175/299 |

*Primary Examiner*—Stephen J. Novosad
*Assistant Examiner*—Terry Lee Melius

[57] ABSTRACT

A drilling jar is disclosed. The jar has particular application in directional drilling operations and includes a swivel which allows the drilling jar to operate substantially independently of any right hand torque that becomes trapped in the drill string. The swivel includes a bearing cage that engages the polished stem of the drilling jar to the jay stem of the drilling jar. This bearing cage holds a number of bearings against the jay stem and the polished stem. The swivel allows the jay stem to rotate substantially independently of the polished stem. The drilling jar may further include splines formed onto the outer surface of the polished stem for transmitting torque from the polished stem to the barrel of the drilling jar without simultaneously transmitting torque from the polished stem to the jay stem. In addition, the drilling jar may include floating pistons that are circumferentially engaged to the polished stem and the washpipe that effect the upper and lower seals on the drilling jar and allow the internal pressure inside the tool to be equalized with the internal and external pressures of the drill string.

12 Claims, 10 Drawing Figures

Fig.1A
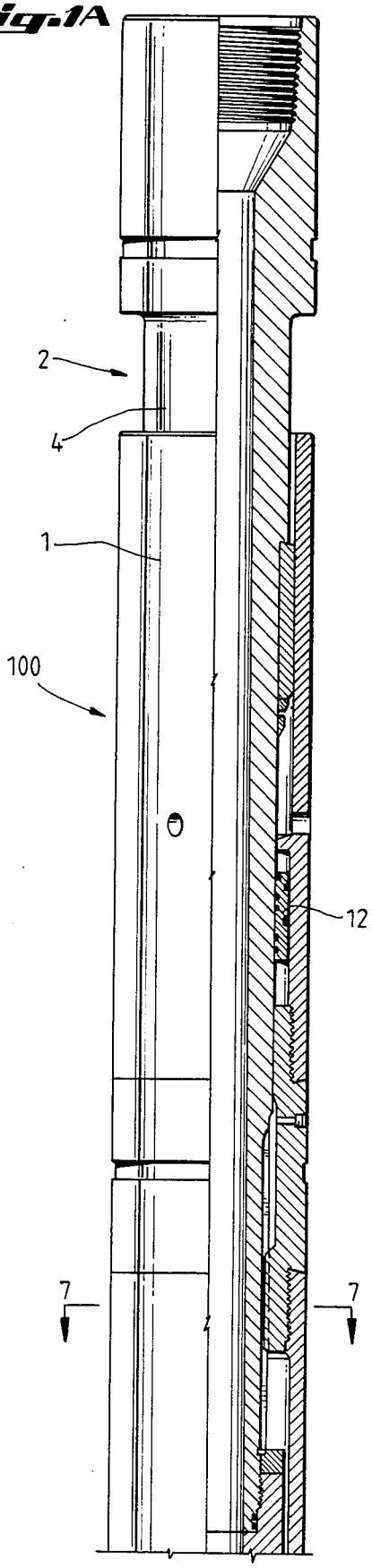
Fig.2A
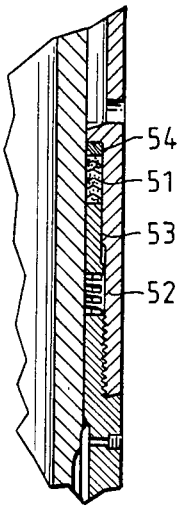
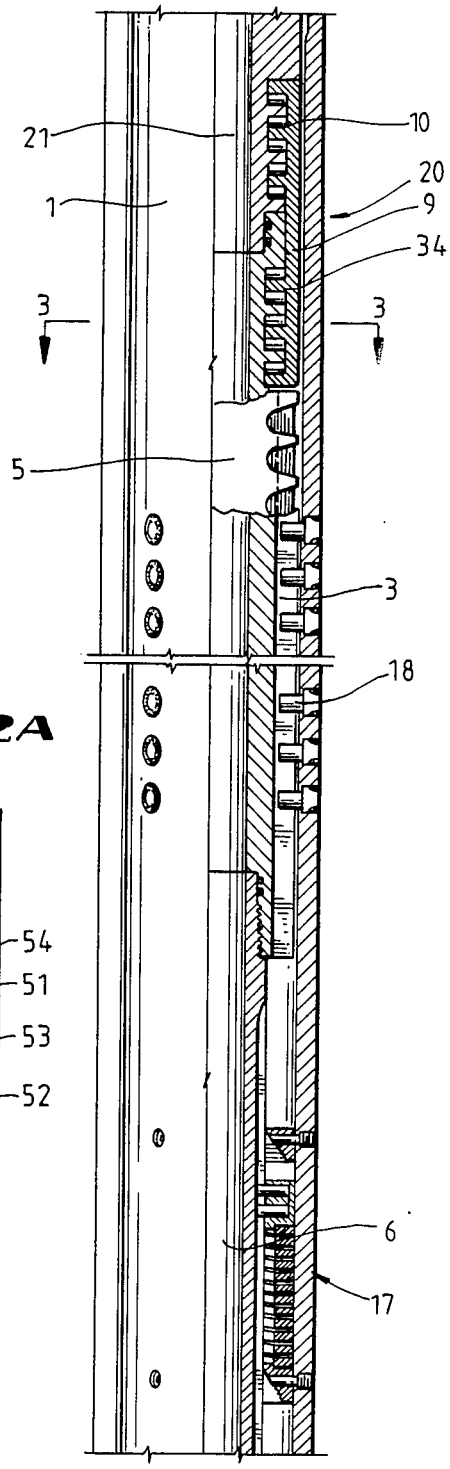
Fig.1B

MECHANICAL DIRECTIONAL DRILLING JAR WITH SWIVEL MEANS

FIELD OF THE INVENTION

The present invention relates to rotary drilling jars. The invention has particular application for the directional drilling of wells.

BACKGROUND OF THE INVENTION

Drilling jars are typically installed into a drill string that normally incorporates a drill bit at the bottom, various drill collars thereabove, stabilizers as necessary, and a plurality of drill pipe to extend from the kelly at the derrick to the bottom of the borehole. A drilling jar is included into the drill string to enable an operator to deliver a jar or jolt to the drill string whenever the drill string becomes stuck during drilling operations. In addition, the drilling jar may be used to apply an impact to an object that is stuck in the borehole. This impact should knock the stuck object loose, allowing it to be retrieved from the borehole.

Under normal drilling operations, conventional drilling jars perform satisfactorily. Some types of mechanical jars can be adjusted downhole to increase the triggering force, thus the intensity of the blow, by applying right hand torque when stuck. Under certain drilling conditions, if too much right hand torque is applied and cannot be released because of the configuration of the well, it becomes difficult or impossible for the drilling jar to trigger and deliver a blow in either the upward or downward direction.

During drilling operations, the drill bit has a tendency to "walk right" producing a corkscrew configuration of the bore hole. This configuration is more pronounced during fast drilling. Moreover, in directional drilling, the formation discontinuities and deviation procedures add "dog legs" to the bore hole. The corkscrew configuration and dog legs trap the right hand torque applied for drilling, making the jar triggering action more difficult or even impossible.

The method normally used to overcome this trapped right hand torque is to work left hand torque down the drill string to the drilling jar, approximately one round at a time. This method is very time consuming, thus costly. In directional drilling wells, the corkscrew configuration and dog legs present in the bore hole may impede the left hand torque from reaching the jar. Thus, right hand torque remains trapped in the tool. The jar can not be triggered and cannot provide an upward or downward hammering action. This problem is more acute for high angle holes and any directional well drilled at a fast rate of penetration.

SUMMARY OF THE INVENTION

The present invention provides a drilling jar which is substantially independent of right hand torque that may become trapped in the drill string.

One advantage of the present invention is that it provides a drilling jar which can operate in directional drilling wells, particularly those of high inclination.

Another advantage of the present invention is that it provides a drilling jar which eliminates the need to work left hand torque down the drill string, thus reducing cost in drilling operations in which the drill string may become stuck.

Additional advantages of the invention will be set forth in part in the description which follows, and in part will be obvious from the description, or may be learned by practice of the invention.

In accordance with the present invention as embodied and broadly described herein, a drilling jar is provided that is substantially independent of right hand torque that has built-up in the drill string.

As in conventional drilling jars, the jar includes upper and internal lower longitudinally arranged tubular parts that are telescopically arranged within a barrel. The upper and internal lower parts are movable longitudinally relative to the barrel, allowing these parts to deliver a jar or jolt to the drill string. The mechanism allowing the drilling jar to jolt the drill string is substantially the same as in the conventional drilling jars delineated in U.S. Patent Nos. 3,208,541 and 3,233,690 (hereinafter referred to as "conventional drilling jars").

Unlike conventional drilling jars, however, the upper and internal lower tubular parts of the drilling jar of the present invention are coupled to allow these parts to rotate substantially independently of each other. Allowing these parts to rotate substantially independently helps ensure that right hand torque is not transmitted from the remainder of the drill string to the tripping mechanism of the drilling jar. Therefore, the drilling jar mechanism is substantially free of right hand torque build-up and is fully functional, even under conditions in which right hand torque builds up in the remainder of the drill string.

In a preferred embodiment of the drilling jar, a swivel engages the upper and internal lower tubular parts of the drilling jar. This swivel enables the upper and internal lower parts to rotate substantially independently from each other. The inclusion of the swivel, allowing the internal lower part of the drilling jar to rotate substantially independent of the upper part, helps prevent the build-up of trapped right hand torque into the tripping mechanism of the drilling jar. Since the amount of trapped right hand torque is substantially reduced, this drilling jar does not require left hand torque to be worked down the string before the jarring mechanism is used.

A preferred embodiment of the drilling jar of the present invention further includes a top packing and a lower floating piston; an alternate design includes a pair of floating pistons. In this alternative design, one floating piston is circumferentially engaged to a portion of the lower part of the drilling jar and the other floating piston is engaged to a portion of the upper part of the drilling jar. These floating pistons may effect the upper and lower seals on the drilling jar.

The upper floating piston enables the internal pressure inside the drilling jar to be equalized with the annulus pressure outside the drill string. Equalizing these pressures decreases the likelihood that the drilling jar will collapse when the external pressure exerted upon the jar is substantially greater than the internal pressure inside the jar. The lower floating piston enables the internal pressure inside the drilling jar to be equalized with the internal pressure in the drill string. Equalizing these pressures decreases the likelihood that the drilling jar will burst when the internal pressure inside the jar is substantially greater than the external pressure in the drill string. Further, these floating pistons decrease the likelihood that a pressure lock will result in the drilling jar when the jar impacts the drill string.

In addition, in a preferred embodiment the upper part of the drilling jar may include a polished stem, having a number of splines that are formed onto its outer surface. These splines mesh with splines formed onto the inner surface of the barrel to transmit torque from the polished stem to the barrel of the drilling jar, without simultaneously transmitting torque to the internal lower part of the drilling jar. Since torque is not transmitted from the barrel to the internal tripping mechanism, any torque built-up in the drill string does not have a significant affect upon the operation of the jar.

DESCRIPTION OF THE DRAWINGS

FIGS. 1A–1C is a partial cross-sectional view of an embodiment of the drilling jar of the present invention.

FIG. 2A is a partial cross-sectional view of the drilling jar shown in FIG. 1A in which conventional sealing apparatus are used in place of a floating piston.

DETAILED DESCRIPTION OF PREFERRED EMBODIMENTS

Figure 1C:
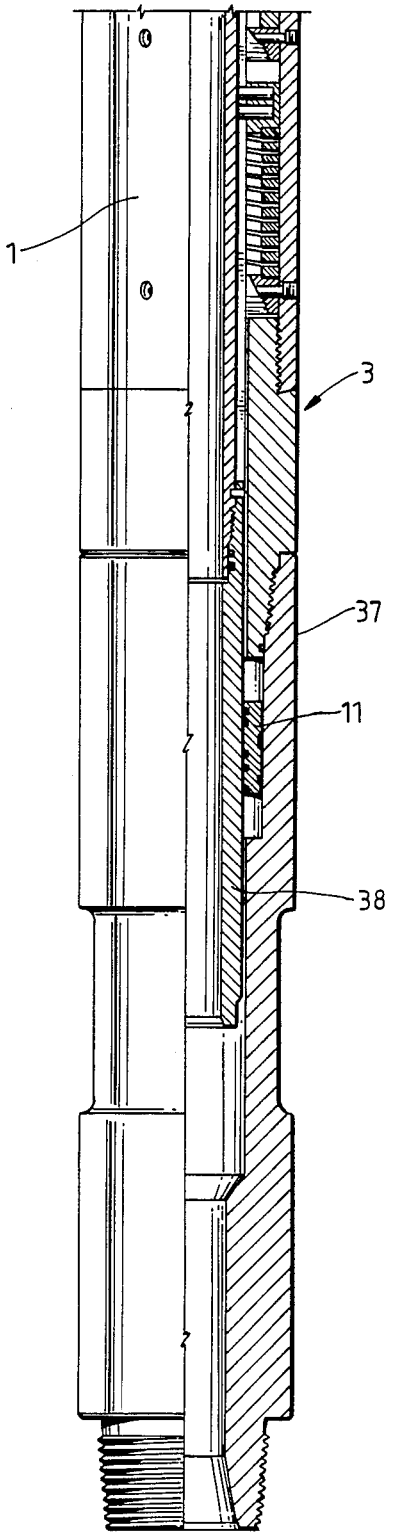

Referring to the drawings, FIGS. 1A–1C shows a drilling jar 100 having a barrel 1, upper longitudinally arranged tubular part 2 and internal lower longitudinally arranged tubular part 3. Upper and internal lower tubular parts 2, 3 are shown in their operable position within barrel 1. Further, in accordance with the present invention, FIGS. 1A–1C shows upper part 2 coupled to internal lower part 3 in a manner that enables internal lower part 3 to rotate substantially independently of the rotational movement of upper part 2.

FIG. 1B further shows that in a preferred embodiment of the present invention a swivel 20 is used to couple upper part 2 to internal lower part 3, allowing internal lower part 3 to move substantially independently of any rotational movement of upper part 2. In this preferred embodiment, the swivel 20 couples the polished stem 4 to the jay stem 5. The swivel 20 allows jay stem 5 to move substantially independently of the rotational movement of polished stem 4.

Since jay stem 5 may move substantially independently of the rotational movement of polished stem 4, torque built-up in the drill string will not, for the most part, be transmitted to jay stem 5. It should be appreciated that such a feature helps to prevent right hand torque from becoming trapped in the drilling jar. Thus, the addition of swivel 20 to the embodiment shown in FIGS. 1A–1C increases the likelihood that the drilling jar will be able to deliver a jar in either the upward or downward direction, even if right hand torque becomes trapped in the drill string.

In addition to the coupling arrangement between jay stem 5 and polished stem 4, the preferred embodiment of the present invention shown in FIGS. 1A–1C further includes means for engaging polished stem 4 to barrel 1. This engagement means enables torque built-up in polished stem 4 to be transmitted to barrel 1, without simultaneously transmitting torque to jay stem 5. Thus, torque built-up in polished stem 4 will not affect the internal workings of the jar.

Figure 7:
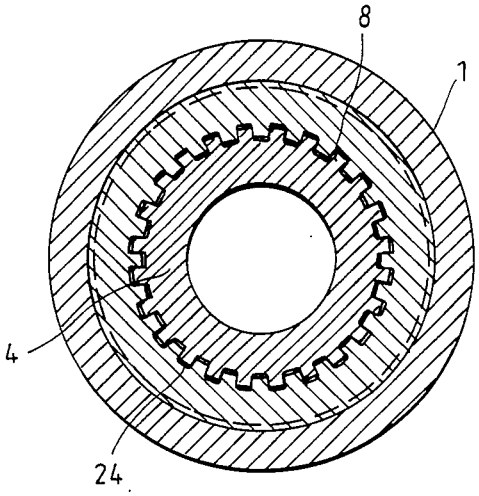
FIG. 7 is a cross-section of a portion of the embodiment of the drilling jar shown in FIG. 1A along the line 7—7, showing the splines of the polished stem in engagement with the barrel.

This engagement means is shown in FIG. 7 as a series of splines 8 formed onto the outer surface of polished stem 4. The number and shape of these splines 8 may vary from the one shown in FIG. 7.

As shown in FIG. 7, splines 8 engage grooves 24 cut out of barrel 1. Splines 8 ensure that torque built-up in polished stem 4 will be transmitted to barrel 1. Consequently, these splines 8 protect swivel 20 from the drilling torque. Because swivel 20 allows jay stem 5 to rotate substantially independently of polished stem 4, splines 8 ensure that torque built-up in barrel 1 will not be transmitted to jay stem 5. Likewise, any torque built-up in polished stem 4 will be transmitted through splines 8 to barrel 1 without simultaneously being transmitted to jay stem 5.

The engagement between splines 8 and grooves 24 helps ensure that right hand torque that becomes trapped in the drill string will not be transmitted to jay stem 5. Thus, the drilling jar will remain substantially free of any torque build-up that becomes trapped in the drill string. This, in turn, enables the drilling jar 100 to deliver a jar under conditions in which the build-up of right hand torque in the drilling string may make it difficult or perhaps impossible to operate a conventional drilling jar.

In the preferred embodiment shown in FIGS. 1A–1C, swivel 20 includes a bearing cage 9 and a plurality of bearings 10. Bearing cage 9 connects jay stem 5 to the polished stem adapter 21, which is connected to polished stem 4, and holds bearings 10 against the outer surfaces of jay stem 5 and polished stem adapter 21.

Figure 2B:
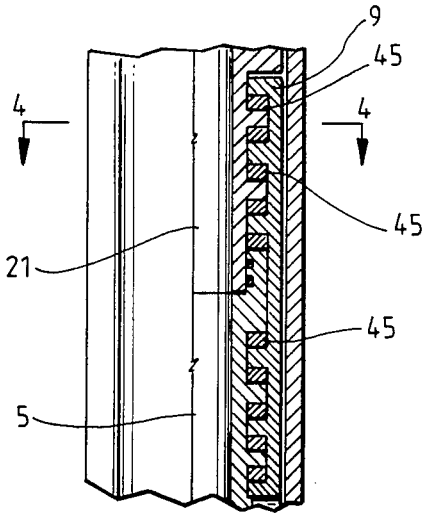
FIG. 2B is a partial cross-sectional view of the drilling jar shown in FIG. 1B in which slotted bearings are used instead of the bearings shown in FIG. 3.
Figure 3:
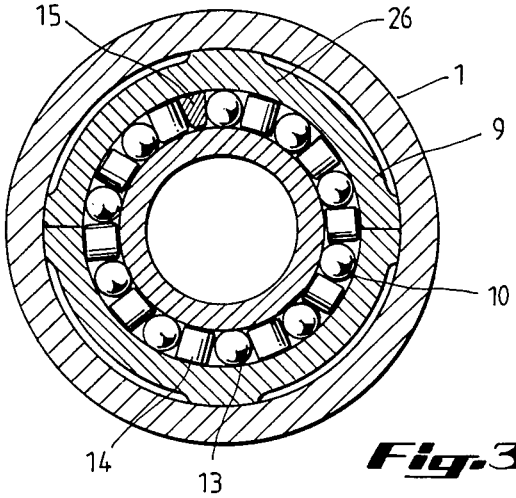
FIG. 3 is a cross-section of the portion of the drilling jar shown in FIG. 1B, along the line 3—3, showing the bearings and bearing cage that form the swivel in this embodiment.

FIG. 1B shows an embodiment in which bearings 10 include ball bearings 13 and roller bearings 14, shown in FIG. 3. FIG. 2 shows an embodiment in which bearings 10 include slotted bearings 45 rather than the ball bearings 13 and roller bearings 14 in FIG. 3.

Figure 6:
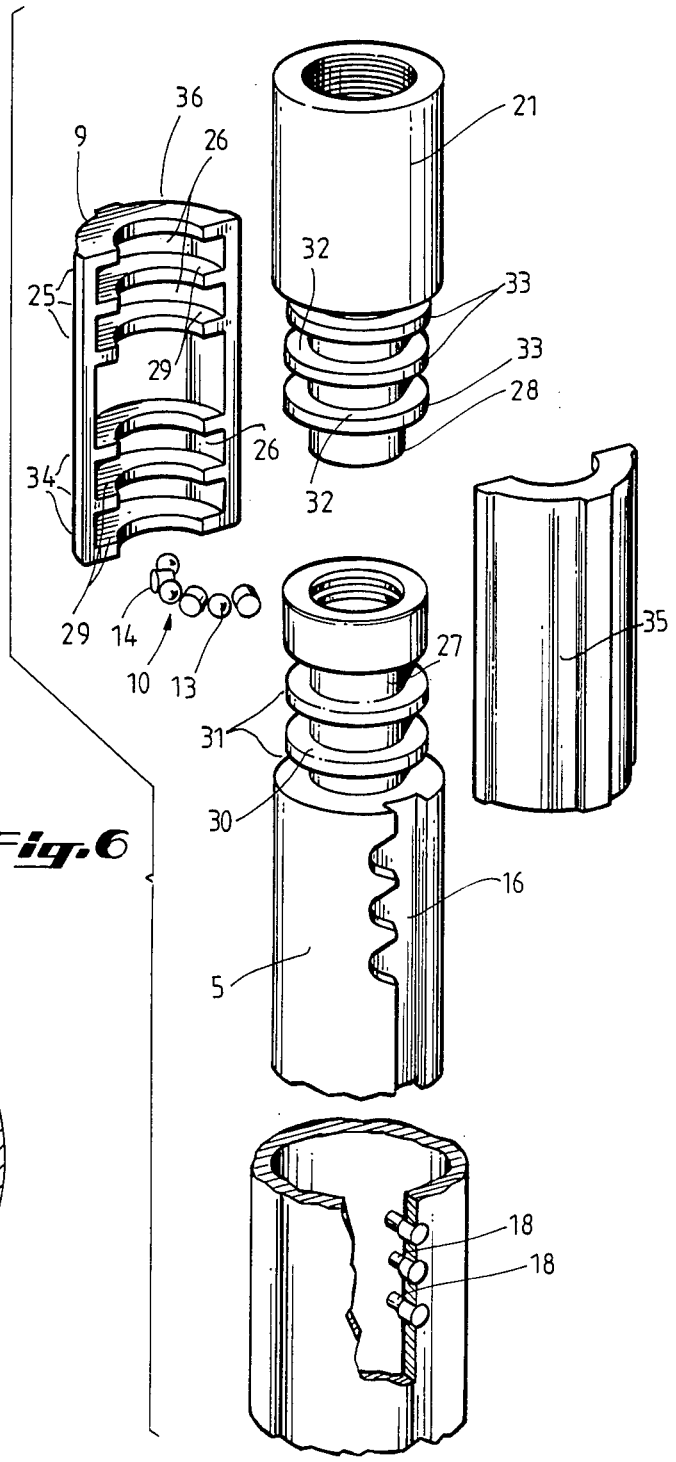
FIG. 6 is an exploded view of the bearings, bearing cage, polished stem adapter, and upper end of the jay stem of the embodiment of the drilling jar shown in FIG. 1.

FIG. 6 is an exploded view showing the manner in which bearing cage 9 connects jay stem 5 to polished stem adapter 21 and holds bearings 10 against polished stem adapter 21 and jay stem 5. As shown in FIG. 6, the sections 25 and 34 of bearing cage 9, having a smaller inner diameter than sections 26 of bearing cage 9, envelope shaft 27 of jay stem 5 and shaft 28 of polished stem adapter 21. Perpendicular faces 29 of bearing cage 9 allow bearing cage 9 to engage perpendicular faces 30 of upsets 31 of jay stem 5 and perpendicular faces 32 of upsets 33 of the polished stem adapter 21.

Sections 25 and 34 of bearing cage 9 ensure that any longitudinal movement of polished stem 4 will result in the longitudinal movement of jay stem 5. For example, if polished stem 4 is pulled in an upward direction, perpendicular faces 32 of the polished stem adapter 21 will pull on sections 25 of bearing cage 9. Sections 25 will, in turn, pull upon sections 34 of bearing cage 9. Sections 34 will, in turn, pull upon perpendicular faces 30 of jay stem 5, causing jay stem 5 to be pulled in an upward direction. Thus, bearing cage 9 engages polished stem 4 to jay stem 5 in a manner that enables an upward pull on polished stem 4 to effect an upward pull on jay stem 5.

Likewise, bearing cage 9 engages polished stem 4 to jay stem 5 in a manner that transmits a pushing force exerted upon polished stem 4 to jay stem 5. Thus, forcing polished stem 4 in a downward direction causes jay stem 5 to move in a downward direction, allowing the drilling jar 100 to deliver a jar in the downward direction.

As in conventional drilling jars, rollers 18, shown in FIGS. 1B and 6, on barrel 1 are held in grooves 16 of jay stem 5, engaging barrel 1 to jay stem 5. An upward pull or downward push on jay stem 5 causes rollers 18 on barrel 1 to release from grooves 16 of jay stem 5, thereby causing the drilling jar to deliver a jar in the upward or downward direction.

As is further shown in FIG. 6, sections 26 of bearing cage 9 envelope bearings 10, holding bearings 10 against shaft 27 of jay stem 5 and shaft 28 of polished stem adapter 21. Bearings 10 allow jay stem 5 to rotate substantially independently of polished stem 4.

FIG. 3 shows a cross-section of a most preferred embodiment of bearings 10. In this embodiment, bearings 10 include an equal number of ball bearings 13 and roller bearings 14. Ball bearings 13 and roller bearings 14 may be made of any material able to withstand stresses exerted during drilling operations. Ball bearings 13 are each separated by roller bearings 14 and roller bearings 14 are each separated by ball bearings 13. A spacer 15 may be used to allow ball bearings 13 and roller bearings 14 to be appropriately spaced for engagement with shaft 27 and shaft 28.

FIG. 3 further shows section 26 of bearing cage 9 in engagement with bearing 10 and further shows barrel 1 enveloping bearing cage 9.

Figure 4:
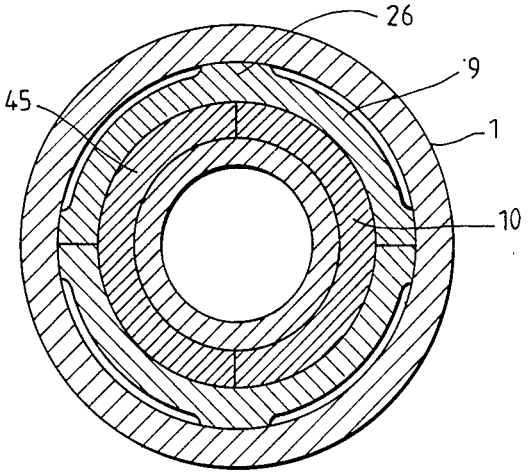
FIG. 4 is the cross-section shown in FIG. 2B along the line 4—4, showing slotted bearings in place of the bearings in FIG. 3.

FIG. 4 is a cross-section of FIG. 2, showing an embodiment in which bearings 10 are slotted bearings 45 rather than the ball bearings 13 and roller bearings 14 shown in FIG. 3.

The use of ball bearings 13 and roller bearings 14, shown in FIG. 3, is preferred to the use of the slotted bearings 45, shown in FIG. 4, or other types of bearing arrangements, since the arrangement shown in FIG. 3 helps reduce the amount of friction in swivel 20.

FIG. 1B shows that in a most preferred embodiment the drilling jar of the present invention has ten bearings 10. Five of these bearings 10 engage polished stem adapter 21 and five bearings 10 engage jay stem 5. As shown in FIG. 1B, six of the bearings 10 are positioned to resist an upward pull on the drilling jar 100 and four of the bearings 10 are positioned to resist a downward push on the drilling jar 100. Additional bearings 10 are used to resist an upward pull since the pulling force on the drilling jar is usually substantially greater in the upward direction than in the downward direction.

When an upward force is applied to the drilling jar 100, three of the bearings 10 engaging polished stem adapter 21 will be forced in the upward direction by faces 32 of upsets 33 of polished stem adapter 21. In addition, when such an upward pull is applied, faces 29 of sections 34 of bearing cage 9 push against three of the bearings 10 engaged at shaft 27 of the jay stem 5. Thus, in this embodiment, an upward pull of the drilling jar 100 impacts six of the bearings 10.

When the drilling jar 100 is pushed downward, faces 32 of upsets 33 of polished stem adapter 21 push against two of the bearings 10 that are engaged to polished stem adapter 21 and faces 29 of lower sections 34 of bearing cage 9 push against two of the bearings 10 that engage shaft 27 of jay stem 5. Thus, a downward force on the drilling jar impacts four of the bearings 10.

FIG. 6 shows an exploded view of swivel 20, that is used to connect jay stem 5 to polished stem 4. Ball bearings 13, roller bearings 14 and spacer 15 are positioned around the top half of shaft 27 of jay stem 5 and shaft 28 of polished stem adapter 21. The top half 35 of bearing cage 9 is then placed on top of ball bearings 13, roller bearings 14 and spacer 15 to hold these bearings against shaft 27 and shaft 28. Jay stem 5 and polished stem adapter 21 are then rotated until this half of bearing cage 9 is positioned underneath jay stem 5 and polished stem adapter 21. After being rotated to this position, the remainder of the ball bearings 13 and the roller bearings 14 are positioned along the top half of jay stem 5 and polished stem adapter 21.

Once these ball bearings 13 and roller bearings 14 are in position, producing bearings 10, the other half 36 of bearing cage 9 is placed over ball bearings 13 and roller bearings 14 to hold these bearings against this half of jay stem 5 and polished stem adapter 21. In a preferred embodiment, such as that shown in FIGS. 1A–1C, the resulting assembly will include ten bearings 10 that bearing cage 9 holds against jay stem 5 and polished stem adapter 21.

After swivel 20 is assembled, any suitable means may be used to hold the two halves of bearing cage 9 together. For example, a high strength tape may be used. After bearing cage 9 is placed in position, barrel 1 may be slid over this section of the drilling jar 100 until barrel 1 envelopes this portion of the drilling jar 100. Once the barrel 1 is in place, the spring 17, shown in FIG. 1B, may be inserted to hold rollers 18 into grooves 16, as in conventional drilling jars.

While swivel 20 has been described with respect to two preferred embodiments, those skilled in the art will appreciate a number of modifications that may be made to swivel 20 and a number of variations to the embodiment shown. For example, jay stem 5 could be modified to allow polished stem adapter 21 to be inserted into jay stem 5. In such an embodiment, the inner surface of jay stem 5 could be used, in place of bearing cage 9, to hold bearings 10 against the outer surface of polished stem adapter 21. Likewise, polished stem adapter 21 could be modified to enable jay stem 5 to be inserted into polished stem adapter 21. In such an embodiment, the inner surface of polished stem 21 could hold bearings 10 against jay stem 5.

In the alternative, a ball and socket arrangement between jay stem 5 and polished stem adapter 21 might be used to enable jay stem 5 to rotate substantially independently of the rotational movement of polished stem 4. Thus, it should be appreciated that any modification that enables upper part 2 to be coupled to lower part 3 to allow lower part 3 to move substantially independently of the rotational movement of upper part 2 falls within the scope of the present invention.

The embodiment shown in FIGS. 1A–1C shows the spring stem 6 and washpipe 7 of conventional drilling jars. As in conventional devices, spring stem 6 is shown threaded to jay stem 5 and washpipe 7 is shown threaded to spring stem 6.

FIGS. 1A–1C further shows that a preferred embodiment of a drilling jar of the present invention may include floating pistons 11 and 12. Floating piston 11 enables the internal pressure inside the drilling jar 100 to be equalized with the internal pressure in the drill string. Floating piston 12 enables the internal pressure inside the drilling jar 100 to be equalized with the external annulus pressure. Equalizing these pressures decreases the likelihood that the drilling jar will burst or collapse, even if the external pressure exerted upon the drilling jar is substantially greater than or substantially less than the internal pressure inside the drilling jar. Further, the floating pistons decrease the likelihood that a pressure lock will result in the drilling jar when the jar impacts the drill string.

Figure 5:
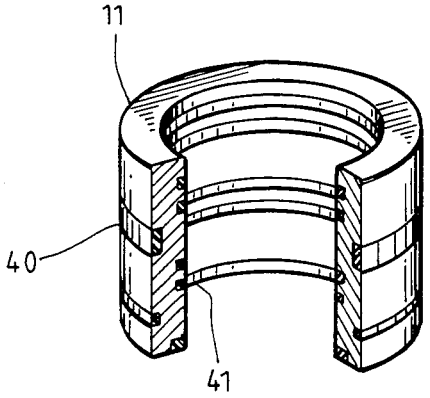
FIG. 5 is a perspective view of the floating piston shown in FIG. 1.

As shown in FIG. 1C, floating piston 11 is circumferentially engaged to washpipe 7. FIG. 5 is a perspective view of floating piston 11. Seals 40, 41 are preferably used to seal the outer diameter of floating piston 11 with the inner diameter of the lower end 37 of barrel 1 and to seal the inner diameter of floating piston 11 with the outer diameter of washpipe 7. In such an embodiment, floating piston 11 may move along washpipe 7 to equalize the internal pressure of the drilling jar 100 with the internal pressure of the drill string.

FIG. 1A shows that floating piston 12 may be used in place of the vee packing 51, spring 52, packing sleeve 53, gland ring 54 assembly shown in FIG. 2A, that is used in conventional drilling jars. Floating piston 12, as in conventional apparatus, effects the top seal on the drilling jar 100, keeping mud out of the oil bath which surrounds the driving and jaying mechanisms. Floating piston 12 may slide along polished stem 4 to a greater extent than conventional sealing apparatus and may, together with floating piston 11, help equalize the internal pressure of drilling jar 100 with the internal pressure in the drill string and the external pressure in the annulus.

Floating piston 12 may be substantially identical to floating piston 11, shown in FIG. 5, except that the inner diameter of floating piston 12 may be greater than the inner diameter of floating piston 11. This difference in inner diameters results when the outer diameter of polished stem 4 is greater than the outer diameter of washpipe 7. The outer diameter of washpipe 7 is typically smaller than the outer diameter of polished stem 4 to allow the lower end 38 of the drilling jar 100 to resist the higher stresses that are exerted upon this portion of the drilling jar.

While the present invention has been described with respect to two preferred embodiments, those skilled in the art will appreciate a number of variations and modifications therefrom and it is intended within the appended claims to cover all such variations and modifications as fall within the true spirit and scope of the present invention.

What is claimed is:

1. A drilling jar comprising:

a barrel;

a polished stem, having upper and lower ends, said polished stem engaged to said barrel;

a jay stem having upper and lower ends, said lower end connected to said barrel and including means for enabling the tripping of said drilling jar, said upper end connected to said lower end of said polished stem; means for engaging said polished stem to said barrel; means for engaging said jay stem to said barrel; and a swivel for connecting said lower end of said polished stem to said upper end of said jay stem, enabling said jay stem to rotate substantially independently of the rotational movement of said polished stem.

2. The apparatus of claim 1 wherein said polished stem includes a plurality of splines formed onto the outer surface of said polished stem, said splines enabling said polished stem to transmit torque to said barrel without simultaneously transmitting torque to said jay stem.

3. The apparatus of claim 1 further comprising a spring stem engaged to said jay stem, a washpipe engaged to said spring stem, and a floating piston circumferentially engaging said washpipe for sliding along said washpipe in response to differences in pressure exerted upon the upper and lower surfaces of said floating piston.

4. The apparatus of claim 3 further comprising a floating piston circumferentially engaged to said polished stem for sliding along said polished stem and for effecting a seal between said polished stem and said barrel.

5. The apparatus of claim 1 wherein said swivel comprises at least one bearing circumferentially engaged to either said polished stem or said jay stem for enabling said jay stem to rotate substantially independently of the rotational movement of said polished stem.

6. The apparatus of claim 5 wherein said swivel further comprises a bearing cage for holding each said bearing against said jay stem or said polished stem and for engaging said polished stem to said jay stem.

7. The apparatus of claim 5 wherein each said bearing includes a plurality of ball bearings.

8. The apparatus of claim 7 wherein each said bearing further includes a plurality of roller bearings.

9. A drilling jar comprising:

a barrel;

a polished stem, having upper and lower ends, said polished stem telescopically arranged with said barrel and movable longitudinally relative to said barrel;

a jay stem, having upper and lower ends, said lower end including means for enabling the tripping of said drilling jar, said upper end longitudinally arranged with and connected to said lower end of said polished stem;

a spring stem longitudinally arranged with and engaged to said jay stem;

a washpipe longitudinally arranged with and engaged to said spring stem;

means for engaging said jay stem to said barrel;

means for engaging said spring stem to said jay stem;

means for engaging said washpipe to said spring stem; and a swivel for connecting said lower end of said polished stem to said upper end of said jay stem, enabling said jay stem to rotate substantially independently of the rotational movement of said polished stem.

10. The apparatus of claim 9 further comprising a floating piston circumferentially engaging said washpipe for sliding along said washpipe in response to differences in pressure exerted upon the upper and lower surfaces of said floating piston.

11. The apparatus of claim 9 wherein said means for engaging said polished stem to said barrel include a plurality of splines formed onto the outer surface of said polished stem, said splines enabling said polished stem to transmit torque to said barrel without simultaneously transmitting torque to said jay stem.

12. The apparatus of claim 9 wherein said swivel comprises a plurality of bearings circumferentially engaged to said polished stem and to said jay stem, for enabling said jay stem to rotate substantially independently of the rotational movement of said polished stem, and a bearing cage for holding each said bearing against said jay stem and said polished stem and for engaging said polished stem to said jay stem.

* * * * *

UNITED STATES PATENT AND TRADEMARK OFFICE

CERTIFICATE OF CORRECTION

PATENT NO. : 4,715,454

DATED : December 29, 1987

INVENTOR(S) : Chuan C. Teng, Rene A. Chapelle, John E. Blacklaws
Lee E. McComsey It is certified that error appears in the above-identified patent and that said Letters Patent is hereby corrected as shown below:

In Column 8, line 41

"means for engaging said jay stem to said barrel;" should read -- means for engaging said polished stem to said barrel; means for engaging said jay stem to said barrel --

Signed and Sealed this

Thirty-first Day of May, 1988

*Attest:*

*Attesting Officer*

DONALD J. QUIGG

*Commissioner of Patents and Trademarks*